US006681755B2

(12) United States Patent
Pujos

(10) Patent No.: US 6,681,755 B2
(45) Date of Patent: Jan. 27, 2004

(54) VIBRATION DAMPENING DEVICE

(76) Inventor: Pierre Pujos, 2628 Garfield Rd. N., Suite #38, Traverse City, MI (US) 49686

( * ) Notice: Subject to any disclaimer, the term of this patent is extended or adjusted under 35 U.S.C. 154(b) by 168 days.

(21) Appl. No.: 09/800,789

(22) Filed: Mar. 7, 2001

(65) Prior Publication Data

US 2002/0014231 A1 Feb. 7, 2002

Related U.S. Application Data

(60) Provisional application No. 60/187,705, filed on Mar. 7, 2000.

(51) Int. Cl.[7] ..... F41B 5/20
(52) U.S. Cl. ..... 124/89
(58) Field of Search ..... 124/89

(56) References Cited

U.S. PATENT DOCUMENTS

| | | | | |
|---|---|---|---|---|
| 4,570,608 A | | 2/1986 | Masterfield | 124/89 |
| 4,893,606 A | | 1/1990 | Sisko | 124/89 |
| 5,339,793 A | * | 8/1994 | Findley | 124/89 |
| 5,450,931 A | | 9/1995 | Masuda et al. | 188/268 |
| 5,524,602 A | | 6/1996 | Papandrea et al. | 124/89 |
| 5,595,168 A | | 1/1997 | Martin | 124/89 |
| 5,617,664 A | | 4/1997 | Troncoso | 42/1.06 |
| 6,021,770 A | | 2/2000 | Sodaro | 124/89 |
| 6,283,109 B1 | * | 9/2001 | Wiseby et al. | 124/89 |

* cited by examiner

*Primary Examiner*—John A. Ricci
(74) *Attorney, Agent, or Firm*—Douglas S. Bishop

(57) ABSTRACT

A stabilizer unit, or vibration dampening device, for hand-held implements, generally, and for archery bows, in particular. A closed container incorporated within or attached to the hand-held device is partially filled with a gelatinous mass which mass is attached to the interior of the closed container. A solid weight is suspended in the gelatinous mass. The resilient flexibility of the gelatinous mass allows relative movement of the suspended weight, providing a dampening effect on vibrations in the hand-held device

20 Claims, 3 Drawing Sheets

VIBRATION DAMPENING DEVICE

PRIOR APPLICATION

Applicant claims a priority filing date of Mar. 7, 2000, pursuant to provisional application No. 60/187,705, filed Mar. 7, 2000.

BACKGROUND OF THE INVENTION

This invention relates generally to vibration dampening devices, or stabilizers, for hand-held implements, including, but not limited to, sporting goods, tools, or otherwise, and, specifically, in the preferred embodiment, to stabilizer units for vibration dampening on archery bows. Many, if not most, hand-held devices, in the field of sporting goods, or tools, are subject to inherent vibration, when used in their intended manner for their intended purpose. As an example, hammers and axes, in the field of tools, and bats and rackets, in the field of sporting goods, all generate vibration, when used for their intended purpose. In particular, archery bows, particularly modern, compound bows, generate vibration, upon use, which is multi-directional.

Certainly, the utilization of vibration dampening devices, or stabilizers, generally, is known and, is known particularly in the field of archery. Devices which have been previously utilized to dampen vibration of an archery bow, have utilized moveable pistons, springs, as well as granulated gel modules, and sand, within contained enclosures. Examples of prior art stabilizer applications for archery bows include U.S. Pat. No. 5,617,664, to Troncoso, for a Recoil Absorbing Stabilizer for a Weapon; U.S. Pat. No. 5,524,602, to Papandrea et al, for a Gyro-Kinetic Hydraulic Bow Stabilizer; U.S. Pat. No. 6,021,770, to Sodaro, for a Bow Stabilizer with Game Finder; U.S. Pat. No. 5,595,168, to Martin, for a Dampening Apparatus for an Archery Bow, Handle Riser for an Archery Bow and a Method of Fabricating a Handle Riser for an Archery Bow; U.S. Pat. No. 4,893,606, to Sisko, for a Distributed Mass, Inertial Archery Bow Stabilizer and Vibration Damper; and U.S. Pat. No. 4,570,608, to Masterfield, for an Archery Bow Stabilizer and Vibration Dampener. Relevant prior art, in general, requires use of hydraulics, or springs, in many applications. Applications which may not require use of hydraulics or springs also tend not to be multi-directional dampeners. Existing prior art performance, additionally, may be subject to temperature differentials, and humidity and moisture variation.

Limitations relative to archery applications of vibration dampening devices are applicable, as well, to use with hand-held implements of other types.

Accordingly, a need exists for a vibration dampening device, or stabilizer, suitable for application to the field of archery, and to hand-held implements, generally, which does not contain mechanically connected moving parts, does not contained loose materials, does not require the utilization of springs, or hydraulics, and which will function in generally the same manner under a variety of conditions of temperature and humidity.

SUMMARY OF THE INVENTION

The present invention is directed to the provision of a vibration dampening device, or stabilizer unit, which may be used with a variety of hand-held implements, generally, to dampen, or minimize vibration generally attendant to their use, and, specifically, to a stabilizer unit for archery bows, particularly compound archery bows, to provide the same vibration reducing benefits.

The invention vibration dampening device includes a hollow container, of any shape which may be fully enclosed, but which, in the preferred embodiment, is provided in a cylindrical shape. The container has a unitary rigid inner surface, or wall, and a generally corresponding outside surface. The dimensions of the container and its rigid inner surface between its ends define the volume of the container. The container may be of a hollow cylindrical shape, an oval shape, or any other shape which forms an enclosure sufficient, when closed, to contain a defined volume. Within the hollow container is a semi-solid, resiliently elastic, gelatinous mass. The gelatinous mass fills a portion, but not all, of the container. At least two portions of the container remain unfilled by the gelatinous mass, as available space into which the gelatinous mass may expand, before returning, by nature of its resiliency, to its original shape. The gelatinous mass is attached by an adhesive, or other means of attachment, to the interior, unitary wall of the container. An separate adhesive may be used, or the gelatinous mass itself may be composed of a self-adhering substance, so that, upon contact with the inner wall of the container, the portion which contacts the inner wall of the container becomes affixed to it. In the preferred embodiment, where the container member is a hollow cylinder, the gelatinous mass fills the center portion of the cylinder, so that the exterior surface of the gelatinous mass contacts the unitary rigid inner wall of the cylinder completely around its internal circumference and adheres to it, at all points of contact.

In the preferred embodiment, proximately centered within the gelatinous mass is a spherical solid weight. The weight has a density greater than the gelatinous mass and, as stated, is of a solid, non-pliable substance. In the preferred embodiment, the spherical mass, or weight, will be of metal, or other high-density substance.

In the preferred embodiment, there is a cover, or cap, at each end of the cylindrical container. These covers, or caps, when placed on each respective end of the cylindrical container, seal the same from the elements. There is, however, in the preferred embodiment, as stated previously, a space containing no solid substance, between each end of the container and the gelatinous mass, the volume of the gelatinous mass being proximately centered between the respective ends of the cylindrical container.

At the first end of the cylindrical container, attached to the cap, is a means of attachment, which, in the preferred embodiment, is a threaded bolt attachment, which is rotatably inserted and held within a correspondingly threaded nut-type receiver, affixed to the main body of an archery bow. At the second end, the cap provides simply a sealing function, but, to the extent additional weight at a distance from the bow or other hand-held implement is desired, weight in the form of a larger cap, or an addition to the cap, may be added.

In the preferred embodiment of the invention, the gelatinous mass, or resiliently elastic substance, is, preferably, silicone gel, which is generally impervious to normal ranges of temperature differential and/or changes in humidity.

According to a further feature of the invention, when the bow, or other hand-held implement to which the vibration dampening device is attached, vibrates, the solid spherical mass or weight tends, by inertia, to remain at rest, while the vibration dampening device, and the implement to which it is attached, goes in motion. The resilient elastic nature of the gelatinous substance allows relative movement within the cylinder between the higher density solid weight or mass and either end of the cylinder, and/or the interior circumference of the cylinder. In order to facilitate this relative movement, the gel may, at one or more points, compress, or resiliently expand into open areas not containing mass, within the cylinder, and then retract to its original position. This relative movement of the spherical weight or mass, within the gelatinous mass, in relationship to the cylinder, results in a vibration dampening effect of the device.

According to a further feature of the invention, the container within which is held the gelatinous mass, is an enclosed cavity within a handle, or other part, or appendage, of the hand-held implement. In this embodiment, volume of the container is defined by the volume of the cavity, and the gelatinous mass, which, as previously stated, is proximately centered and adhered to a portion of the inner surface of the container, is of a lesser volume than the volume of the cavity itself. In the preferred embodiment, wherein the container is a cavity within the implement itself, it is preferable, though not required, to have more than one portion of the cavity which does not contain a portion of the mass, with such cavities separated from each other by the gelatinous mass.

As will become apparent, from the detailed description of the preferred embodiment of the archery bow vibration dampening stabilizer, or in any vibration dampening application with any other hand-held implement, the vibration dampening effect is multi-directional.

DETAILED DESCRIPTION OF THE PREFERRED EMBODIMENT

Figure 2:
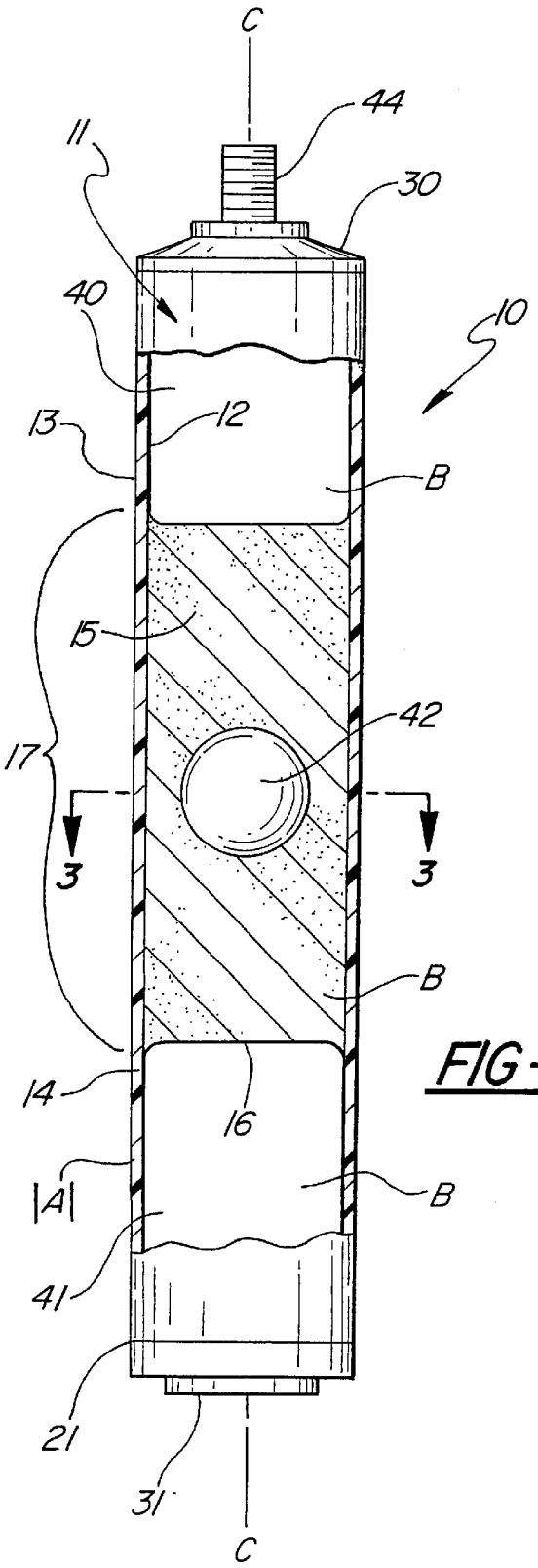
FIG. 2 is a cut-away perspective view of the invention vibration dampening device showing placement of the interior components, at rest.

The invention vibration dampening device 10, broadly considered, includes a hollow container 11, with a unitary, one piece, inner surface 12, of a rigid, non-pliable composition. Corresponding to the inner surface 12, is an outer surface 13. The distance between inner surface 12 and outer surface 13 defines the thickness A of the wall 14 of the hollow container 11.

In the preferred embodiment of the invention, as shown in FIGS. 2, 3, 4 and 7, the hollow container 11 is a cylinder. The hollow container has a first end 20 and a second end 21. The volume B of the container 11 is defined by the unitary inner surface 12 between first end 20 and second end 21.

A first end cap 30 covers first end 20 and the container 11 and a second end cap 22 covers second end 21 of the container 11.

Contained within the container 11 is a gelatinous mass, which is resiliently elastic and, in the preferred embodiment, comprised of silicone gel having a self-adhesive composition, so that the gelatinous mass 11 adheres to any portion of the rigid inner surface 12 with which it is in contact. The gelatinous mass 15 is centered within the hollow container as shown in FIGS. 2, 3, 4, 7 and 8, approximately equidistant from first end 20 and second end 21.

In the preferred embodiment, the gelatinous mass has a volume C defined by its outer surface 16, less than volume B of the hollow cylinder 11, which provides for a first open space 40 and a second open space 41 between the centered gelatinous mass first end 20 and second the end 21, respectively.

Figure 3:
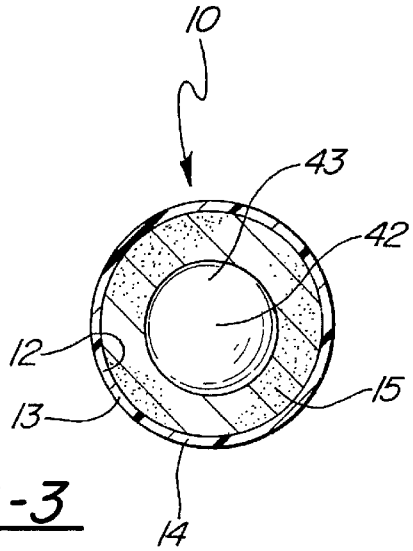
FIG. 3 is a cross-sectional view taken on line 3-3 of FIG. 2.

The outer surface 16 of the gelatinous mass 15 contacts the unitary inner surface 12 about its inner circumference as shown in FIG. 3, at all points between first open space 40 and second space 41, as shown in FIG. 2.

In the preferred embodiment, the gelatinous mass 15 is affixed to the unitary inner surface 12 across its circumferential contact area 17, by the self-adhering properties of the silicone gel.

However, if the gelatinous mass 15 is comprised of other resiliently elastic material which is not self-adhering, a separate adhesive element may be utilized.

Suspended within the gelatinous mass 15 is a symmetrical weight 42. Weight 42 is of a rigid, non-pliable composition, of greater density than the gelatinous mass 15. In the preferred embodiment, weight 42 is comprised of a metal composition and is spherical as shown in FIGS. 2, 3, 4, 7 and 8. Weight 42 is suspended within mass 15 within the container 11 in a position central to its cross-section dimension as shown in FIG. 3 so that its outer surface 43 is centered within the inner circumference of the unitary inner surface 12 and so that he weight is located approximately equidistant between first end 20 and second end 21 of the container member 11.

Figure 4:
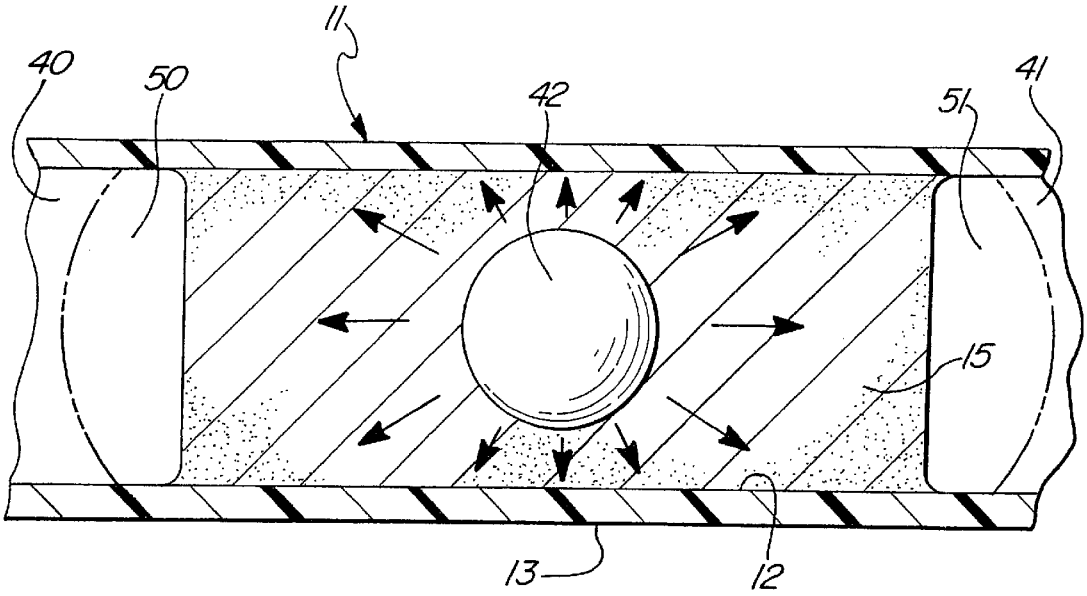
FIG. 4 is a cut-away view of a portion of the container member demonstrating the multi-directional mobility of the suspended weight and the available expansion area for the gelatinous mass.
Figure 5:
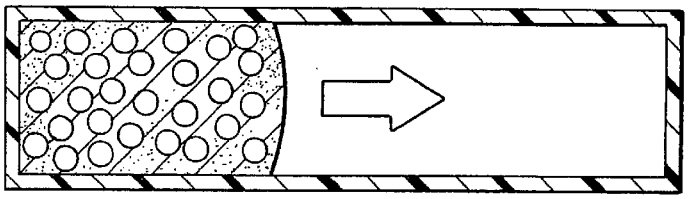
FIG-5 PRIOR ART
FIG. 5 is a cut-away view of a stabilizer of the prior art showing beaded gel as a moveable element.
Figure 6:
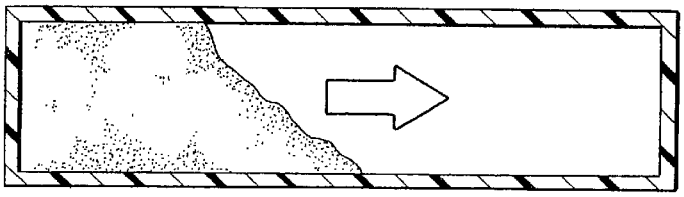
FIG-6 PRIOR ART
FIG. 6 is a cut-away view of a stabilizer of the prior art showing sand as a moveable element.

Open areas 40 and 41 provide spaces 50 and 51, respectively, as shown in FIG. 4, for potential resilient, temporary expansive movement of the gelatinous mass 15. The central position of the weight 42 within the gelatinous mass 15 allows multi-directional relative movement between the weight and the container 11, as shown by directional arrows in FIGS. 4 and 8. Such relative movement is available throughout 360 degrees in unlimited planes of motion. Relative movement between the container 11 and weight 42 and return of the weight 42 to its original centered position provides the vibration dampening effect of the invention 10.

Figure 1:
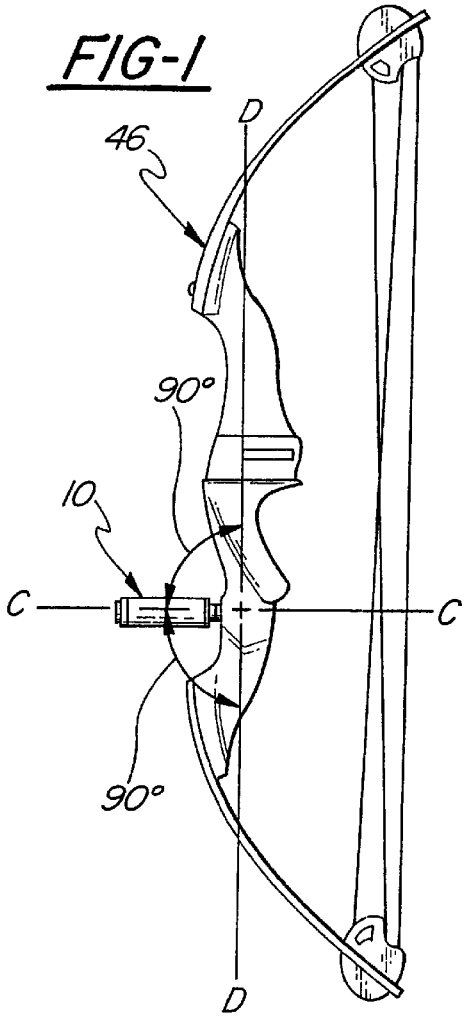
FIG. 1 is a perspective view of an archery bow with a vibration dampening device attached.
Figure 7:
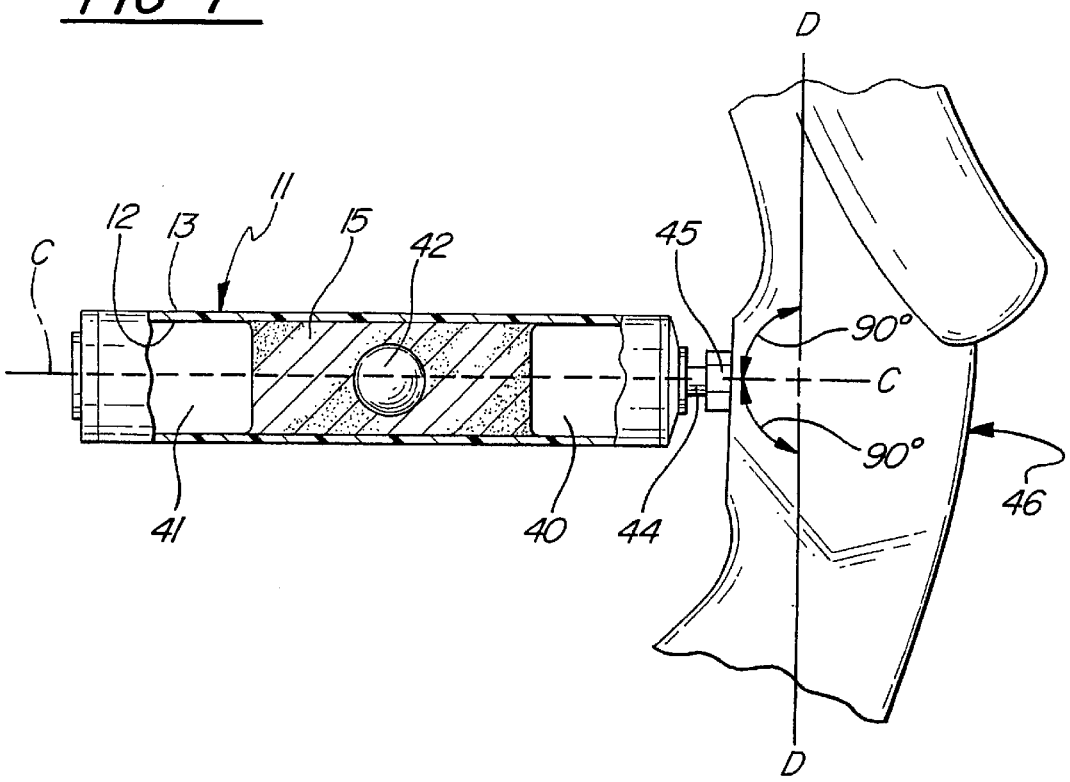
FIG. 7 demonstrates a cut-away view of FIG. 2, with the device attached to the handle portion of an archery bow.
Figure 8:
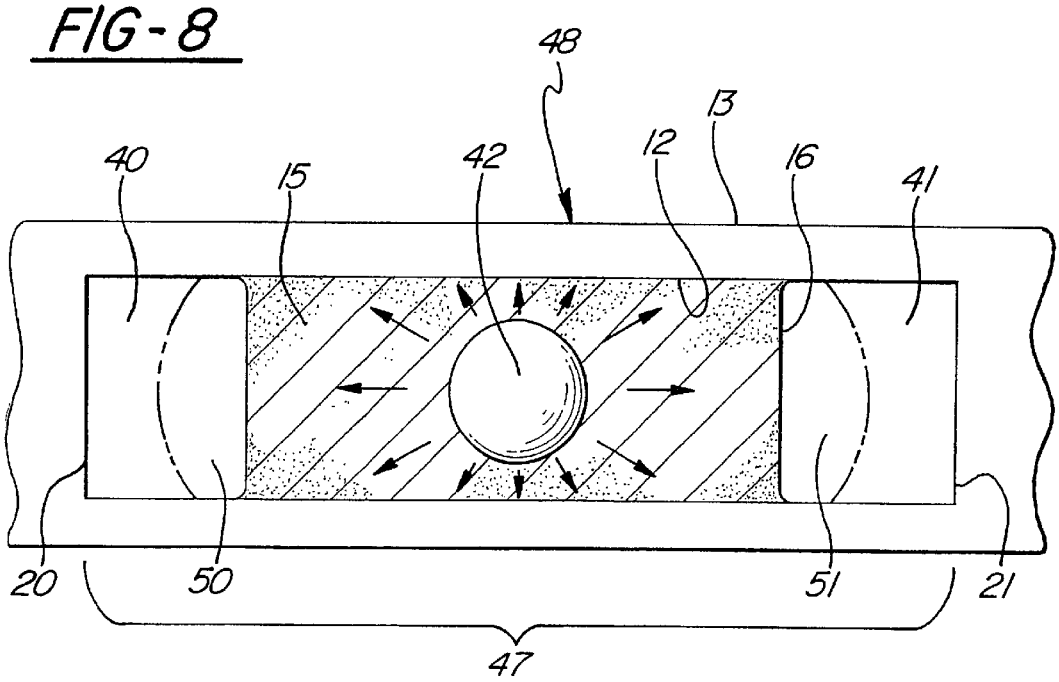
FIG. 8 is a cut-away view of an embodiment of the invention wherein the container element is a cavity within a portion of the hand-held implement.

As a further preferred embodiment, a threaded bolt member is affixed to first end cover 30 at first end 20 of the container 11. Bolt member 44 extends outward from end cover 30 on axis C-C which is longitudinally centered through container 11. A correspondingly threaded nut-type receiver assembly 45 is attached to an archery bow assembly 46, as shown in FIGS. 1 and 7, so that, when affixed, axis C-C is generally at right angles to the general vertical axis D-D of the bow assembly 46.

The device 10 is attached and removably secured to the bow assembly 46 by rotational insertion of the bolt member 44 into the receiver assembly 45 and removed by opposite rotational movement.

In a further adaptation of the preferred embodiment, the container member 11 may be formed by a cavity 47 within a portion of any hand-held implement 48 as shown in FIG.

8. The cavity is self-enclosed to form unitary inner surface 12 and first end cap 30 and second end cap 31 within the composition of the implement 48, with the opposing outer surface 13 being the exterior of the hand-held instrument 48. Such a variation may be placed in a handle, appendage or main body portion of any hand-held instrument. The relationship of the unitary inner surface 12, the gelatinous mass 15, the weight 42, areas of potential expansion 50 and 51, and open arcas 40 and 41 remain the same as in the first described preferred embodiment.

Whereas a preferred embodiment of the invention has been shown and described in detail, it will be apparent that various other changes may be made in the disclosed embodiment without departing from the spirit of the invention.

What is claimed is:

1. A vibration dampening device affixed to a hand-held implement, comprising:

a hollow container member having a unitary, rigid inner surface and an opposing outer surface, and defining a contained volume;

a gelatinous mass having an external surface defining a lesser volume than that defined by the rigid inner surface of the container member and contained within the container member;

a portion of the external surface of the gelatinous mass contacting the rigid inner surface of the container member;

a means for affixing the portion of the outer surface of the gelatinous mass to the rigid inner surface of the container member across the area of contact; and a solid, weighted member of greater density than the gelatinous mass, suspended within the gelatinous mass.

2. The dampening device of claim 1, wherein the hand-held instrument is an archery bow.

3. The dampening device of claim 1, wherein the gelatinous mass is comprised of a silicone gel material.

4. The dampening device of claim 1, wherein container member is removably attached to the hand-held implement.

5. The dampening device of claim 1, wherein the container member comprises a cavity defined by the hand-held implement.

6. The dampening device of claim 1, wherein the external surface of the gelatinous mass is affixed to the rigid inner surface of the container member by adhesive means.

7. The dampening device of claim 6, wherein the gelatinous mass is comprised of self-adhesive material.

8. The dampening device of claim 1, wherein the solid weighted member is proximately centered within the gelatinous mass.

9. The dampening device of claim 1, wherein the device further comprises a means for removably affixing the device to the hand-held implement.

10. A vibration dampening device for an archery bow, comprising:

a hollow, cylindrical container member having a rigid, unitary, inner surface, and an opposing outer surface, said unitary inner surface defining a contained volume, and said cylindrical container member having a first end and a second end;

a gelatinous mass having an external surface defining a lesser volume than that defined by the rigid inner surface of the container member;

a portion of the external surface of the gelatinous mass continually contacting the rigid inner surface of the cylindrical container member about its inner circumference;

a means for affixing the portion of the external gelatinous mass to the rigid inner surface of the cylindrical container member across the area of contact;

a solid, weighted member, of greater density than the gelatinous mass, suspended within the gelatinous mass at proximately centered position;

a first end cap member corresponding to the first end of the cylindrical container member; and a second end cap member corresponding to the second end of the cylindrical container member; and a means of attaching the device to an archery bow.

11. The vibration dampening device of claim 10, wherein a portion of the external surface of the the gelatinous mass is affixed to the rigid inner surface of the cylindrical container member by adhesive means.

12. The vibration dampening device of claim 10, wherein the solid, weighted member comprises a solid sphere.

13. The vibration dampening device of claim 10, wherein the means of affixing the device to an archery bow comprises a threaded bolt member attached to and outwardly extending from the first end cap member, and a correspondingly threaded receptacle attached to the archery bow, conformed to receive and hold the threaded bolt member.

14. A vibration dampening device for an archery bow, comprising:

a hollow, cylindrical container member having a rigid, unitary, inner surface, and an opposing outer surface, said unitary inner surface defining a contained volume, and said cylindrical container member having a first end and a second end;

a gelantinous mass comprised of silicone gel having an external surface defining a lesser volume than that defined by the rigid inner surface of the container member;

a portion of the external surface of the genatinous mass continually contacting the rigid inner surface of the cylindrical container member about its inner circumference;

a means for affixing the portion of the external gelatinous mass to the rigid inner surface of the cylindrical container member across the area of contact;

a solid, weighted member, of greater density than the gelatinous mass, suspended within the gelatinous mass at proximately centered position;

a first end cap member corresponding to the first end of the cylindrical container member; and a second end cap member corresponding to the second end of the cylindrical container member; and a means of attaching the device to an archery bow.

15. The vibration dampening device of claim 14, wherein a portion of the external surface of the gelatinous mass is affixed to the rigid inner surface of the cylindrical container member by adhesive means.

16. The vibration dampening device of claim 15, wherein the gelatinous mass is comprised of self-adhesive material.

17. The vibration dampening device of claim 15, wherein the gelatinous mass is comprised of self-adhesive material.

18. The vibration dampening device of claim 14, wherein the solid, weighted member comprises a solid sphere.

19. The vibration dampening device of claim 14, wherein the means of affixing the device to an archery bow comprises a threaded bolt member attached to and outwardly extending from the first end cap member, and a correspondingly threaded receptacle attached to the archery bow, conformed to receive and hold the threaded bolt member.

20. The vibration dampening device of claim 14, wherein the device, when affixed to the archery bow, extends outwardly from the archery bow so that the axis of the center of the cylindrical container member between the first end and second end is at substantially right angles to the archery bow.

* * * * *